US006610152B1

(12) United States Patent
Babain et al.

(10) Patent No.: US 6,610,152 B1
(45) Date of Patent: Aug. 26, 2003

(54) METHOD FOR REMOVING INORGANIC MATTER FROM SOLID SURFACES

(75) Inventors: Vassily A. Babain, St. Petersburg (RU); Andrey A. Murzin, St. Petersburg (RU); Igor V. Smirnov, St. Petersburg (RU); Vadim A. Starchenko, St. Petersburg (RU); Andrey Y. Shadrin, St. Petersburg (RU); Neil Graham Smart, Workington (GB)

(73) Assignee: British Nuclear Fuels PLC, Cumbria (GB)

( * ) Notice: Subject to any disclaimer, the term of this patent is extended or adjusted under 35 U.S.C. 154(b) by 0 days.

(21) Appl. No.: 09/701,234

(22) PCT Filed: May 24, 1999

(86) PCT No.: PCT/GB99/01629

§ 371 (c)(1),
(2), (4) Date: Mar. 15, 2001

(87) PCT Pub. No.: WO99/62072

PCT Pub. Date: Dec. 2, 1999

(30) Foreign Application Priority Data

May 22, 1998 (RU) ..... 98109964

(51) Int. Cl.[7] ..... C23G 1/02

(52) U.S. Cl. ..... 134/3; 134/2; 134/36; 134/41; 134/42; 423/3; 423/11; 423/21.1

(58) Field of Search ..... 134/2, 3, 36, 41, 134/42; 423/3, 11, 21.1

(56) References Cited

U.S. PATENT DOCUMENTS

| | | | | | |
|---|---|---|---|---|---|
| 5,356,538 | A | * | 10/1994 | Wai et al. | 210/634 |
| 5,606,724 | A | * | 2/1997 | Wai et al. | 423/3 |
| 5,653,884 | A | * | 8/1997 | Smart et al. | 210/634 |
| 5,730,874 | A | | 3/1998 | Wai et al. | 210/638 |
| 5,770,085 | A | * | 6/1998 | Wai et al. | 210/638 |
| 5,792,357 | A | * | 8/1998 | Wai et al. | 210/638 |
| 5,834,316 | A | * | 11/1998 | Smart et al. | 436/178 |
| 5,840,193 | A | * | 11/1998 | Smart et al. | 210/638 |
| 6,132,491 | A | * | 10/2000 | Wai et al. | 75/722 |
| 6,149,828 | A | * | 11/2000 | Vaartstra | 216/57 |
| 6,176,895 | B1 | * | 1/2001 | DeSimone et al. | 75/723 |
| 6,187,911 | B1 | * | 2/2001 | Wai et al. | 534/11 |

FOREIGN PATENT DOCUMENTS

| | | | |
|---|---|---|---|
| WO | WO95/29000 | * | 11/1995 |
| WO | WO95/33542 | * | 12/1995 |
| WO | WO98/04753 | * | 2/1998 |

* cited by examiner

*Primary Examiner*—Sharidan Carrillo
(74) *Attorney, Agent, or Firm*—Darby & Darby

(57) ABSTRACT

Metal ions are removed from solid surfaces which may be contaminated with one or more radionuclides by contacting the solid surfaces with the supercritical fluid, as, for instance, carbon dioxide containing both an acidic ligand and organic amine. The metal ions are extracted from the solid surface and the extract is separated from the solid surface.

9 Claims, No Drawings

METHOD FOR REMOVING INORGANIC MATTER FROM SOLID SURFACES

This application is a national phase application under 35 U.S.C. §371 of International Application No. PCT/GB99/01629, filed May 24, 1999, which was published in English on Dec. 2, 1999 as International Publication No. WO 99/62072, and claims the benefit of Russian Patent Application No. 98109964, filed May 22, 1998.

FIELD OF THE INVENTION

The invention is concerned with the removal of inorganic matter from solid surfaces using supercritical fluids. Methods of the invention can be used for the decontamination of radioactive waste.

BACKGROUND TO THE INVENTION

The problem of removal of adsorbed metal ions, in particular of radionuclides, from the surface of stainless steel is usually solved by treating the surface with aqueous solutions, foams or suspensions of acids and/or complexones. Such methods are disclosed in (N I Ampelogova, Yu M Simanovskii, A A Trapeznilov: Decontamination in the nuclear power industry. Moscow, Energiozdat, 1982, p 140–152: and Dippel T, Hentschel D, Kunze S: Kerntechnik, 1976, Vol 18, No 12, p 526–531:

The application of these methods makes it possible to remove metal ions from the surfaces but leads to the production of secondary waste, namely acidic solutions containing radionuclides. This can cause a substantial increase of the total volume of wastes. As a result of the use of such a method the radionuclides are transferred to a solution. In order to secure their safe storage it is necessary to convert them into an ecologically benign form, and this causes further problems. Consequently, a method that reduces the volume of secondary waste and facilitates the transformation of the radionuclides into an ecologically safe form will lead to a cheaper and safer decontamination process.

Methods are known for the supercritical extraction of metal complexes with the help of carbon dioxide gas in the presence of complexones (diethyl-dithio carbamates, bis-(trifluoromethyl)-dithio carbamates/K E Laintz, C M Wai, C R Yonker, R D Smith, Extraction of Metal Ions from Solid and Liquid materials by Supercritical Carbon Dioxide, Anal Chem, 1992, Vol 64, p 2875–78; tributyl phosphate/Y Lin, R D Brauer, K E Laintz, C M Wai, Supercritical Fluid Extraction of Lanthanides and Actinides from solid Materials with fluorinated β-diketones, Anal Chem 1993, Vol 65, p 2549–2551; triazolo-crown ethers/S Wang, S Elshani, C M Wai, Selective Extraction of Mercury with Ionisable Crown Ethers in Supercritical Carbon dioxide, Anal Chem 1997/), and also β-diketones/Y Lin, C M Wai, F M Jean, R D Brauer, Supercritical Fluid Extraction of Thorium and Uranium Ions from solid and Liquid Materials with Fluorinated β-diketones and Tributyl Phosphate, Environ Sci Technol, 1994, Vol 28, No 6, p 1190–93.; Wai C M, Smart N G, Phelps C, Extraction of Metals Directly from Oxides, U.S. Pat. No. 5,606,724 A Publ Feb. 25, 1997.

In using a β-diketone and tributyl phosphate a sample of the material (sand, paper etc) may be covered with an acetate buffer solution with pH=4.0 which contains a metal (10 μg). β-diketone (40–80 μmol) and tributyl phosphate (40 μmol) are added. The sample is placed in supercritical carbon dioxide which contains methanol or water where it is kept for 10 minutes at 60° C. and 150 bar. The flask is then washed with 10 flask volumes of clean carbon dioxide and the extract is collected in water.

This method has the following disadvantages: For complete extraction of the metal a large excess of β-diketone is required (400–1000 mol per 1 mol of metal) and the extraction must be done from a buffer solution. It is impossible to achieve a sufficiently complete extraction of the salt formed by the metal from a stainless steel surface. Extraction of transuranium elements has not been reported so far.

The aim of the method of the invention is to remove from the surface of solid bodies metallic contaminants, including radioactive ones. It is important that the contaminating metals will be removed from the surface, irrespective of their chemical form (ie salts, oxides, etc).

BRIEF SUMMARY OF THE INVENTION

A method is proposed for the removal of inorganic matter from a solid surface, which may be contaminated with one or more radionuclides, the method comprising contracting the solid surface with a supercritical fluid, for instance supercritical carbon dioxide, which contains an acidic ligand and an organic amine, and collecting the resultant extract in a suitable solvent The method of the present invention does not require preliminary covering of the surface with a buffer solution. It is possible to extract radionuclides in practically all their chemical forms (chlorides, nitrates, sulphates, oxides, etc).

DETAILED DESCRIPTION OF THE INVENTION

An acidic ligand of use in the present invention is one which can be deprotonated. An example of an acidic ligand is a β-dicarbonyl compound, for instance a β-diketone or a β-keto-ether.

A preferred β-dicarbonyl compound has the formula

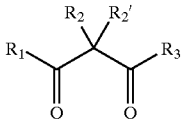

where $R_1$, $R_2$, $R'_2$ and $R_3$ are each independently selected from hydrogen, alkyl, aryl, fluorine-substituted alkyl, alkoxyl, furyl, substituted furyl, thienyl and substituted thienyl. Examples of β-diketones of use in the present invention are acetylacetone, trifluoroacetylacetone, hexafluoroacetylacetone, thienoyltrifluoroacetylacetone and FOD (a compound in which $R_1$ is t-butyl, $R_2$ is hydrogen, $R'_2$ is hydrogen and $R_3$ is n-$C_3F_7$).

The proposed method enables one to extract the metals contaminating the surface with a substantially lower excess of, for instance, a β-diketone than in the case of the known β-diketone method (10–200 mol β-diketone against 400–1000 mol β-diketone per mol metal in the known method). This significantly reduces the costs of the process since β-diketone is quite an expensive reagent.

The carbon dioxide gas can be easily collected and used again in the process. In comparison with the method using, for instance, aqueous solution, the volume in which the radionuclides are collected is 10–100 times smaller and the separation of radionuclides from it is much simpler.

The organic amine is preferably an aromatic or heterocyclic amine and is more preferably a pyridine, a quinoline or an aniline compound.

Preferred amines of use in the present invention include pyridine, an alkylpyridine, quinoline, an alkylguinoline, dipyridine and dimethyl aniline.

Preferably the supercritical fluid additionally contains water.

Following contact between the supercritical fluid and the solid surface, the resultant extract is preferably collected into a suitable solvent. Preferred solvents include water, an aqueous or aqueous organic solvent and an organic solvent.

EXAMPLES

The following examples illustrate some of the applications of the method of the present invention.

Example 1

A plate made from stainless steel which contained on its surface 10 μg of uranyl nitrate was placed in an extraction flask having a volume of 5 ml. This was then filled with carbon dioxide at a pressure of 400 bar and temperature of 60° C., which contained 0.02% vol hexafluoroacetyl acetone, 0.02% vol pyridine and 0.02% vol water. The flask was left under these conditions for 20 minutes. It was then washed with 10 flask volumes of clean carbon dioxide and the extract collected. The extraction of uranium mounted to 90%.

Example 2 (Comparative Example)

A plate made from stainless steel which contained on its surface 1500 μg of cobalt nitrate was placed in an extraction flask having a volume of 5 ml. The flask was then filled with carbon dioxide gas at a pressure of 300 bar and a temperature of 80° C. which contained 0.2% vol hexafluoroacetyl acetone and 0.2% vol water. The flask was left under these conditions for 20 minutes. It was then washed for 20 minutes with 10 flask volumes of clean carbon dioxide and the extract was collected in carbon tetrachloride. The extraction of cobalt amounted to 30%.

Example 3

A plate made from stainless steel which contained on its surface 800 μg of uranyl nitrate was placed in an extraction flask having a volume of 5 ml. The flask was filled with carbon dioxide at a pressure of 300 bar and a temperature of 60° C. which contained 0.2% vol trifluoroacetyl acetone, 0.2% vol lutidine and 0.2% vol water. The flask was left under these conditions for 20 minutes, then washed for 30 minutes with 10 flask volumes of clean carbon dioxide and the extract was collected. The extraction of uranium amounted to 65%.

Example 4

A plate made from stainless steel which contained on its surface 800 μg of uranium nitrate was placed in an extraction flask having a volume of 5 ml. The flask was filled with carbon dioxide at a pressure of 300 bar and a temperature of 60° C. which contained 2% vol trifluoroacetyl acetone, 2% vol pyridine and 2% vol water. The flask was left under these conditions for 20 minutes and then washed for 20 minutes with 10 flask volumes of clean carbon dioxide. Then the extract was collected. The extraction of uranium amounted to over 98%.

Example 5

A plate made from stainless steel which contained on its surface 1500 μg of uranium trioxide was placed in an extraction flask having a volume of 5 ml. The flask was filled with carbon dioxide at a pressure of 300 bar and a temperature of 60° C. which contained 0.2% vol trifluoroacetyl acetone, 0.2% vol α-picoline and 0.2% water. The flask was left under these conditions for 20 minutes and then washed for 20 minutes with 10 flask volumes of clean carbon dioxide. Then the extract was collected. The extraction of uranium amounted to 95%.

Example 6

A plate made from stainless steel which contained on its surface 1000 μg of thorium chloride was placed in an extraction flask having a volume of 5 ml. The flask was filled with carbon dioxide at a pressure of 300 bar and a temperature of 60° C. which contained 0.2% vol trifluoroacetyl acetone, 0.2% vol pyridine and 0.2% vol water. The flask was left under these conditions for 40 minutes, then washed for 20 minutes with 10 flask volumes of clean carbon dioxide and the extract was collected. The extraction of thorium was 86%.

Example 7

A plate made from stainless steel which contained on its surface plutonium (IV) and neptunium (V) nitrates was placed in an extraction flask having a volume of 5 ml. The flask was filled with carbon dioxide at a pressure of 300 bar and a temperature of 60° C. which contained 0.2% vol trifluoroacetyl acetone, 0.2% vol pyridine and 0.2% vol water. The flask was left under these conditions for 20 minutes, then washed for 30 minutes with 10 flask volumes of clean carbon dioxide and the extract was collected. The extraction amounted to 97% of the plutonium and 98% of the neptunium.

Example 8

A plate made from stainless steel which contained on its surface plutonium (IV) and neptunium (V) oxides was placed in an extraction flask having a volume of 5 ml. The flask was filled with carbon dioxide at a pressure of 300 bar and a temperature of 60° C. which contained 0.2% vol trifluoroacetyl acetone, 0.2% vol pyridine and 0.2% vol water The flask was left under these conditions for 20 minutes, then washed for 30 minutes with 10 flask volumes of clean carbon dioxide and the extract was collected. The extraction amounted to 66% of the plutonium and 84% of the neptunium.

Example 9

A plate made from titanium which contained on its surface 1500 μg of uranium trioxide was placed in an extraction flask having a volume of 5 ml. The flask was filled with carbon dioxide at a pressure of 300 bar and a temperature of 60° C. which contained 0.2% vol trifluoroacetyl acetone, 0.2% vol α,α-dipyridine and 0.2% vol water. The flask was left under these conditions for 20 minutes, then washed for 20 minutes with 10 flask volumes of carbon dioxide and the extract was collected. The extraction of uranium amounted to 95%.

Example 10

A sample of sand which contained on its surface 800 μg of uranyl nitrate was placed in an extraction flask having a volume of 5 ml. The flask was filled with carbon dioxide at a pressure of 300 bar and a temperature of 60° which contained 2% vol trifluorocetyl acetone, 2% vol pyridine and 2% vol water. The flask was left under these conditions for 20 minutes, then washed for 20 minutes with 10 flask volumes of clean carbon dioxide and the extract was collected. The extraction of uranium amounted to 98%.

Example 11

A sample of paper which contained on its surface 800 μg of uranyl nitrate was placed in an extraction flask having a volume of 5 ml. The flask was filled with carbon dioxide at a pressure of 300 bar and a temperature of 60° C. which contained 2% vol trifluoroacetyl acetone, 2% vol N,N-dimethyl aniline and 2% vol water. The flask was left under these conditions for 20 minutes, then washed for 20 minutes with 10 flask volumes of clean carbon dioxide and the extract was collected. The extraction amounted to 90%.

Example 12

A sample of asbestos which contained on its surface 800 μg of uranyl nitrate was placed in an extraction flask having a volume of 5 ml. The flask was filled with carbon dioxide at a pressure of 300 bar and a temperature of 60° C. which contained 2% vol trifluoroacetyl acetone, 2% vol dimethyl quinoline (quinaldine) and 2% water. The flask was left under these conditions for 20 minutes, then washed for 20 minutes with 10 flask volumes of clean carbon dioxide and the extract was collected. The extraction amounted to 80%.

Example 13

A sample of rubber which contained on its surface 800 μg of uranyl nitrate was placed in an extraction flask having a volume of 5 ml. The flask was filled with carbon dioxide at a pressure of 300 bar and a temperature of 60° which contained 2% vol trifluoroacetyl acetone, 2% vol N,N-dimethyl aniline and 2% water. The flask was left under these conditions for 20 minutes, then washed for 20 minutes with 10 flask volumes of clean carbon dioxide and the extract collected. The extraction amounted to 82%.

Example 14 (Comparative Example)

Paper was covered with an acetate buffer layer with pH=4.0, then uranium was added (10 μg, 0.05 μmol by metal, in the form of uranyl nitrate) together with tributyl phosphate (40 μmol). The sample was placed in an extraction flask having a volume of 5 ml which was then filled with carbon dioxide gas at a pressure of 150 bar and temperature of 60° C. The carbon dioxide contained 80 μmol (16.6 mg) hexafluoroacetyl acetone and 2% vol water. The flask was kept under these conditions for 20 minutes, then washed for 20 minutes with 10 flask volumes of clean carbon dioxide and the extract was collected in methanol. The extraction of uranium amounted to 11%.

Example 15 (Comparative Example)

Paper was covered with an acetate buffer layer with pH=4.0, then uranium was added (10 μg, 0.05 μmol by metal, in the form of uranyl nitrate) together with tributyl phosphate (40 μmol). The sample was placed in an extraction flask having a volume of 5 ml which as then filled with carbon dioxide gas at a pressure of 150 bar and a temperate of 60° C. The carbon dioxide contained 80 μmol (16.6 mg) hexafluoroacetyl acetone, 2% vol water and 5% vol methanol. The flask was kept under these conditions for 20 minutes, then washed for 20 minutes with 10 flask volumes of clean carbon dioxide and the extract was collected in methanol. The extraction of uranium amounted to 95%.

Example 16 (Comparative Example)

Paper was covered with an acetate buffer layer with pH=4.0, then were added 800 μg of uranyl nitrate and 40 μmol of tributyl phosphate. The sample was placed in an extraction flask having a volume of 5 ml which was then filled with carbon dioxide gas at a pressure of 150 bar and a temperature of 60° C. The carbon dioxide contained 80 μmol (16.6 mg, 2.5% vol) hexafluoroacetyl acetone and 2% vol water. The flask was kept under these conditions for 20 minutes, then washed for 20 minutes with 10 flask volumes of clean carbon dioxide and the extract was collected in methanol. The extraction of uranium amounted to 5%.

Accordingly, it is clear from comparative Examples 14 to 16 that by the method of the invention the metal can be removed from the surface very effectively with the use of considerably smaller quantities of complexones and without the application of an additional solvent (methanol). When similar amounts of complexones are used, then more than 10 times larger quantities of metal can be extracted by the method of the invention.

What is claimed is:

1. A method for the removal of metal ions from a solid surface comprising: contacting the solid surface with a supercritical fluid which contains a β-dicarbonyl compound and an organic amine; extracting said metal ions from said solid surface to form an extract; and separating said extract from said solid surface; wherein said organic amine is a pyridine or an aniline compound.

2. A method according to claim 1, wherein the solid surface is contaminated with one or more radionuclides.

3. A method according to claim 1, wherein the supercritical fluid is supercritical carbon dioxide.

4. A method according to claim 1, wherein the β-dicarbonyl compound is a β-diketone or a β-keto-ether.

5. A method according to claim 1, wherein the β-dicarbonyl compound has the formula

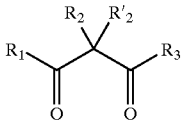

wherein $R_1$, $R_2$, $R'_2$ and $R_3$ are each independently selected from hydrogen, alkyl, aryl, fluorine-substituted alkyl, alkoxyl, furyl, substituted furyl, thienyl and substituted thienyl.

6. A method according to claim 1, wherein the β-dicarbonyl compound is hexafluoroacetylacetone or trifluoroacetylacetone.

7. A method according to claim 1, wherein the organic amine is pyridine, an alkyl pyridine, dipyridine or dimethyl aniline.

8. A method according to claim 1, wherein the supercritical fluid further contains water.

9. A method according to claim 1 wherein the extract resulting from said contact is collected in a solvent selected from the group consisting of an aqueous solvent, an organic solvent, and admixtures thereof.

* * * * *